US010077644B2

(12) United States Patent
Storslett et al.

(10) Patent No.: US 10,077,644 B2
(45) **Date of Patent: *Sep. 18, 2018**

(54) METHOD AND APPARATUS FOR GENERATING HIGH-PRESSURE PULSES IN A SUBTERRANEAN DIELECTRIC MEDIUM

(71) Applicant: Chevron U.S.A. Inc., San Ramon, CA (US)

(72) Inventors: Stein J. Storslett, Bakersfield, CA (US); Rick B. Spielman, Pocatello, ID (US)

(73) Assignee: CHEVRON U.S.A. INC., San Ramon, CA (US)

( * ) Notice: Subject to any disclaimer, the term of this patent is extended or adjusted under 35 U.S.C. 154(b) by 317 days.

This patent is subject to a terminal disclaimer.

(21) Appl. No.: 14/208,525

(22) Filed: Mar. 13, 2014

(65) Prior Publication Data

US 2014/0262226 A1 Sep. 18, 2014

Related U.S. Application Data

(60) Provisional application No. 61/868,391, filed on Aug. 21, 2013, provisional application No. 61/801,304, filed on Mar. 15, 2013.

(51) Int. Cl.
*E21B 43/26* (2006.01)
*E21B 28/00* (2006.01)

(52) U.S. Cl.
CPC ..... *E21B 43/26* (2013.01); *E21B 28/00* (2013.01)

(58) Field of Classification Search
CPC ..... E21B 43/26
See application file for complete search history.

(56) References Cited

U.S. PATENT DOCUMENTS

| | | | |
|---|---|---|---|
| 672,231 | A | 4/1901 | Lacomme |
| 696,647 | A | 4/1902 | Lacomme |
| 781,619 | A | 1/1905 | Rogers |
| 1,152,697 | A | 9/1915 | Bodde |
| 1,253,570 | A | 1/1918 | Berry |
| 1,315,540 | A | 9/1919 | Curme, Jr. |

(Continued)

FOREIGN PATENT DOCUMENTS

| | | | |
|---|---|---|---|
| WO | 2003/069110 | A1 | 8/2003 |
| WO | 2006/023998 | A2 | 3/2006 |
| WO | 2010/027866 | A2 | 3/2010 |

OTHER PUBLICATIONS

Cho, S.H., et al; "Dynamic Fragmentation of Rock by High-Voltage Pulses"; ARMA/USRMS 06-1118, 41st U.S. Symposium on Rock Mechanics (USRMS), Jun. 2006, 9 pages.

(Continued)

*Primary Examiner* — D. Andrews

(57) ABSTRACT

An apparatus and method for generating high-pressure pulses in a subterranean dielectric medium are provided. The method includes providing an electrode assembly in the medium, the electrode assembly having first and second electrodes that define a gap therebetween. A shaped electric current pulse is delivered to the electrode assembly. The electric current pulse has a duration greater than 100 μs so that an electric arc is formed between the first and second electrodes, thereby producing a pressure pulse in the medium.

22 Claims, 4 Drawing Sheets

(56) References Cited

U.S. PATENT DOCUMENTS 1,376,180 A 4/1921 Wickersham
1,744,173 A 1/1930 Longhi
1,861,332 A 5/1932 Waitz
2,162,823 A 6/1939 Phillippi et al.
2,167,536 A 7/1939 Suits
2,403,990 A 7/1946 Mason
2,559,227 A 7/1951 Rieber
2,617,080 A 11/1952 Nims
2,660,556 A 11/1953 Butler
2,822,148 A 2/1958 Murray
2,870,376 A 1/1959 Tognola
2,871,943 A 2/1959 Bodine, Jr.
2,887,604 A 5/1959 Bodine, Jr.
2,931,947 A 4/1960 Fruengel
2,946,217 A 7/1960 Fruengel
3,007,133 A 10/1961 Padberg, Jr.
3,016,095 A 1/1962 Bodine
3,129,403 A 4/1964 Harter
3,149,372 A 9/1964 Stinger
3,157,498 A 11/1964 Zernow et al.
3,158,207 A 11/1964 Rowley
3,160,952 A 12/1964 Corney et al.
3,163,141 A 12/1964 Wesley et al.
3,169,577 A 2/1965 Sarapuu
3,179,187 A 4/1965 Sarapuu
3,180,418 A 4/1965 MacLeod
3,181,328 A 5/1965 Zeitlin
3,181,799 A 5/1965 Wurzburg et al.
3,188,844 A 6/1965 Schwinghamer
3,200,626 A 8/1965 Callender
3,203,212 A 8/1965 Simicich
3,207,447 A 9/1965 Whitham
3,208,674 A 9/1965 Bailey
3,220,873 A 11/1965 Wesley
3,222,902 A 12/1965 Brejcha et al.
3,225,252 A 12/1965 Schrom et al.
3,225,578 A 12/1965 Krieger
3,228,221 A 1/1966 Zernow et al.
3,232,085 A 2/1966 Inoue
3,232,086 A 2/1966 Inoue
3,234,429 A 2/1966 Schrom
3,245,032 A 4/1966 Knott et al.
3,248,917 A 5/1966 Herring, Jr.
3,251,027 A 5/1966 Huckabay et al.
3,253,442 A 5/1966 Grove, Jr. et al.
3,267,710 A 8/1966 Inoue
3,267,780 A 8/1966 Roth
3,268,028 A 8/1966 Miller
3,273,365 A 9/1966 Felts
3,282,294 A 11/1966 Corniello
3,286,226 A 11/1966 Kearsley et al.
3,304,533 A 2/1967 Huckabay et al.
3,332,510 A 7/1967 Clark
3,338,080 A 8/1967 Golden
3,352,503 A 11/1967 Maroudas
3,354,344 A 11/1967 Schrom
3,356,178 A 12/1967 Nash, Jr.
3,358,487 A 12/1967 Brejcha et al.
3,364,708 A 1/1968 Padberg, Jr.
3,366,564 A 1/1968 Allen
3,368,194 A 2/1968 Cholet et al.
3,369,217 A 2/1968 Luehrmann et al.
3,371,404 A 3/1968 Lemelson
3,376,633 A 4/1968 Wesley
3,386,507 A 6/1968 Lumpkin
3,394,569 A 7/1968 Smith
3,401,473 A 9/1968 Schrom et al.
3,402,120 A 9/1968 Allen et al.
3,403,375 A 9/1968 Wright, Jr. et al.
3,408,432 A 10/1968 Tumm et al.
3,416,128 A 12/1968 Allen
3,418,835 A 12/1968 Erlandson
3,423,979 A 1/1969 Smith et al.
3,428,940 A 2/1969 Huckabay
3,452,565 A 7/1969 Cadwell
3,458,858 A 7/1969 Wright, Jr.
3,486,062 A 12/1969 Schrom
3,491,010 A 1/1970 Ishibashi
3,500,942 A 3/1970 Smith, Jr.
3,512,384 A 5/1970 Inoue
3,522,167 A 7/1970 Allen
3,537,542 A 11/1970 Dubois et al.
3,555,866 A 1/1971 Roth
3,566,645 A 3/1971 Lemelson
3,566,647 A 3/1971 Inoue
3,572,072 A 3/1971 Hundley et al.
3,575,631 A 4/1971 Pratt
3,583,766 A 6/1971 Padberg, Jr.
3,588,580 A 6/1971 Vining
3,593,551 A 7/1971 Roth et al.
3,594,115 A 7/1971 Wesley et al.
3,603,127 A 9/1971 Seiffert et al.
3,613,823 A 10/1971 Burrage
3,679,007 A 7/1972 O'Hare
3,688,535 A 9/1972 Keinanen et al.
3,700,169 A 10/1972 Naydan et al.
3,708,022 A 1/1973 Woodruff
3,715,082 A 2/1973 Carley-Macauly et al.
3,725,226 A 4/1973 Stoner
3,728,671 A 4/1973 Poston, Jr.
3,742,746 A 7/1973 Erlandson
3,748,034 A 7/1973 Luebbe
3,750,441 A 8/1973 Schneider et al.
3,786,662 A 1/1974 Roth
3,796,463 A 3/1974 Naydan et al.
3,797,294 A 3/1974 Roth
3,822,747 A 7/1974 Maguire, Jr.
3,840,078 A 10/1974 Allgood et al.
3,840,270 A 10/1974 Allgood, Jr.
3,842,907 A 10/1974 Baker et al.
3,874,450 A 4/1975 Kern
3,881,559 A 5/1975 Allgood et al.
3,923,099 A 12/1975 Brandon
3,931,856 A 1/1976 Barnes
3,946,809 A 3/1976 Hagedorn
3,965,982 A 6/1976 Medlin
3,990,512 A 11/1976 Kuris
4,039,042 A 8/1977 Edwards et al.
4,066,544 A 1/1978 Stark
4,074,758 A 2/1978 Scott
4,076,980 A 2/1978 Arnold et al.
4,084,637 A 4/1978 Todd
4,084,638 A 4/1978 Whiting
4,084,639 A 4/1978 Todd
4,135,579 A 1/1979 Rowland
4,164,978 A 8/1979 Scott
4,169,029 A 9/1979 Smirnov et al.
4,169,503 A 10/1979 Scott
4,196,329 A 4/1980 Debettencourt
4,313,573 A 2/1982 Goldberger et al.
4,343,356 A 8/1982 Riggs et al.
4,345,650 A 8/1982 Wesley
4,401,162 A 8/1983 Osborne
4,458,153 A 7/1984 Wesley
4,471,838 A 9/1984 Bodine
4,479,680 A 10/1984 Wesley et al.
4,487,264 A * 12/1984 Hyne ..... E21B 43/24 166/300
4,525,612 A 6/1985 Kawashima
4,527,085 A 7/1985 Bohan, Jr. et al.
4,540,127 A 9/1985 Andres
4,550,779 A 11/1985 Zakiewicz
4,567,945 A 2/1986 Segalman
4,630,607 A 12/1986 Duinker et al.
4,640,353 A 2/1987 Schuh
4,649,997 A 3/1987 Bousaid
4,651,311 A 3/1987 Owen et al.
4,651,825 A 3/1987 Wilson
4,653,697 A 3/1987 Codina
4,667,738 A 5/1987 Codina
4,715,376 A 12/1987 Nowacki et al.
4,734,894 A 3/1988 Cannelli et al.
4,741,405 A 5/1988 Moeny et al.
4,917,785 A 4/1990 Juvan

(56) References Cited

U.S. PATENT DOCUMENTS

| | | | |
|---|---|---|---|
| 4,957,606 | A | 9/1990 | Juvan |
| 4,990,732 | A | 2/1991 | Dudko et al. |
| 5,004,050 | A | 4/1991 | Sizonenko et al. |
| 5,026,484 | A | 6/1991 | Juvan |
| 5,049,822 | A | 9/1991 | Zoltan |
| 5,105,154 | A | 4/1992 | Givens |
| 5,106,164 | A | 4/1992 | Kitzinger et al. |
| 5,151,630 | A | 9/1992 | Boy et al. |
| 5,228,011 | A | 7/1993 | Owen |
| 5,282,508 | A | 2/1994 | Ellingsen et al. |
| 5,287,382 | A | 2/1994 | Destannes et al. |
| 5,301,169 | A | 4/1994 | Baria et al. |
| 5,368,724 | A | 11/1994 | Ayers et al. |
| 5,386,877 | A | 2/1995 | Codina |
| 5,398,217 | A | 3/1995 | Cannelli et al. |
| 5,425,570 | A | 6/1995 | Wilkinson |
| 5,430,346 | A | 7/1995 | Johnson |
| 5,432,756 | A | 7/1995 | Bryden |
| 5,464,513 | A | 11/1995 | Goriachev et al. |
| 5,482,357 | A | 1/1996 | Wint et al. |
| 5,573,307 | A | 11/1996 | Wilkinson |
| 5,731,655 | A | 3/1998 | Corrado |
| 5,773,750 | A | 6/1998 | Jae et al. |
| 5,896,938 | A | 4/1999 | Moeny et al. |
| 5,948,171 | A | 9/1999 | Grothaus |
| 6,018,502 | A | 1/2000 | Fry, Jr. |
| 6,080,029 | A | 6/2000 | Johnson et al. |
| 6,094,809 | A | 8/2000 | Grassi |
| 6,145,934 | A | 11/2000 | Arai et al. |
| 6,164,388 | A | 12/2000 | Martunovich et al. |
| 6,215,734 | B1 | 4/2001 | Moeny et al. |
| 6,227,293 | B1 | 5/2001 | Huffman et al. |
| 6,269,883 | B1 | 8/2001 | Gissler et al. |
| 6,414,419 | B1 | 7/2002 | Kim |
| 6,427,774 | B2 | 8/2002 | Thomas et al. |
| 6,457,778 | B1 | 10/2002 | Chung et al. |
| 6,591,649 | B1 | 7/2003 | Gafri et al. |
| 6,705,425 | B2 | 3/2004 | West |
| 6,761,416 | B2 | 7/2004 | Moeny et al. |
| 6,978,672 | B1 | 12/2005 | Chen |
| 7,037,040 | B2 | 5/2006 | Phillips |
| 7,233,150 | B2 | 6/2007 | Chen |
| 7,270,195 | B2 | 9/2007 | MacGregor et al. |
| 7,384,009 | B2 | 6/2008 | Moeny |
| 7,398,823 | B2 | 7/2008 | Montgomery |
| 7,416,032 | B2 | 8/2008 | Moeny et al. |
| 7,493,787 | B2 | 2/2009 | Golovashchenko et al. |
| 7,527,108 | B2 | 5/2009 | Moeny |
| 7,530,406 | B2 | 5/2009 | Moeny et al. |
| 7,674,723 | B2 | 3/2010 | Porshnev et al. |
| 7,677,673 | B2 | 3/2010 | Tranquilla et al. |
| 7,721,428 | B2 | 5/2010 | Stoving et al. |
| 8,172,006 | B2 | 5/2012 | Moeny |
| 8,186,454 | B2 | 5/2012 | Moeny |
| 8,220,537 | B2 | 7/2012 | Leon |
| 8,227,779 | B2 | 7/2012 | Neff |
| 8,253,417 | B2 | 8/2012 | Pislak |
| 8,596,349 | B2 | 12/2013 | Leon et al. |
| 8,614,580 | B2 | 12/2013 | Combee |
| 9,394,776 | B2 | 7/2016 | Leon et al. |
| 2003/0205376 | A1 | 11/2003 | Ayoub |
| 2005/0150688 | A1 | 7/2005 | MacGregor |
| 2005/0167099 | A1 | 8/2005 | Phillips |
| 2005/0183858 | A1 | 8/2005 | Ayoub |
| 2005/0279161 | A1 | 12/2005 | Chen |
| 2005/0279497 | A1 | 12/2005 | Chen |
| 2005/0280419 | A1 | 12/2005 | Chen |
| 2006/0038437 | A1 | 2/2006 | Moeny |
| 2006/0151166 | A1 | 7/2006 | Montgomery |
| 2006/0208738 | A1 | 9/2006 | Moore |
| 2007/0152494 | A1 | 7/2007 | Moeny |
| 2007/0175502 | A1 | 8/2007 | Sliwa et al. |
| 2008/0041462 | A1 | 2/2008 | Janway et al. |
| 2008/0277508 | A1 | 11/2008 | Moeny |
| 2009/0050371 | A1* | 2/2009 | Moeny ..... E21B 7/15 175/57 |
| 2009/0294121 | A1 | 12/2009 | Leon |
| 2011/0011592 | A1 | 1/2011 | Leon |
| 2011/0308789 | A1 | 12/2011 | Zhang |
| 2012/0146650 | A1 | 6/2012 | Combee |
| 2012/0194196 | A1 | 8/2012 | Combee |
| 2012/0256634 | A1 | 10/2012 | Morys |
| 2013/0255936 | A1 | 10/2013 | Geilikman et al. |
| 2013/0312957 | A1 | 11/2013 | Grimes |
| 2014/0008072 | A1 | 1/2014 | Rey-Bethbeder |
| 2014/0008073 | A1 | 1/2014 | Rey-Bethbeder et al. |
| 2014/0060814 | A1 | 3/2014 | Leon |
| 2014/0262227 | A1 | 9/2014 | Storslett et al. |

OTHER PUBLICATIONS

Cho, Sang Ho., et al.; "Influence of the Applied Pressure Waveform on the Dynamic Fracture Processes in Rock"; 2004, International Journal of Rock Mechanics & Mining Sciences, vol. 41, pp. 771-784.

Dubovenko, K.V., et al.; "Underwater Electrical Discharge Characteristics at High Values of Initial Pressure and Temperature"; Abstract, 25$^{th}$ IEEE International Conference on Plasma Science, 1998.

Hammon, Jud, et al.; "Electric Pulse Rock Sample Disaggregator"; IEEE International Pulsed Power Conference, 2001, 4 pages.

Loeffler, M., et al.; "Electrical Wire Explosions as a Basis for Alternative Blasting Techniques"; International Conference on Pulsed Power Applications, Mar. 2001, pp. E.16/1-E.16/7.

Madhavan, S., et al.; "Modeling of Shock-Wave Generation in Water by Electrical Discharges"; IEEE Transactions on Plasma Science, vol. 28, No. 5, Oct. 2000, pp. 1552-1557.

Nelson, Lloyd S., et al.; "Aluminum-Enhanced Underwater Electrical Discharges for Steam Explosion Triggering"; Jul. 1999, Sandia National Laboratories Report—SAND99-0796, pp. iii-45.

Sarkar, P., et al.; "Operation of a Capacitor Bank for Plasma Metal Forming"; 2000, Indian Academy of Sciences, vol. 55, Nos. 5 & 6, pp. 941-945.

Touryan, K.J., et al.; "Electrohydraulic Rock Fracturing by Pulsed Power"; 7$^{th}$ IEEE Conference on Pulsed Power 1, (1989), pp. 69-72.

Wakeland, P., et al.; "Hydrodynamic Loading of Structural Components Due to Electrical Discharge in Fluids"; 14$^{th}$ IEEE Conference on Pulsed Power 2, Jun. 2003, pp. 925-928.

Weise, Th. H.G.G., et al.; "Experimental Investigations on Rock Fracturing by Replacing Explosives with Electronically Generated Pressure Pulses"; 1993, 9$^{th}$ IEEE Conference on Pulsed Power 1, pp. 19-22.

Andres, U., et al.; "Liberation of Mineral Constituents by High-Voltage Pulses"; Powder Technology, 1986, vol. 48, pp. 269-277.

Andres, U.; "Liberation Study of Apatite—Nepheline Ore Comminuted by Penetrating Electrical Discharges"; International Journal of Mineral Processing, 1977, vol. 4, pp. 33-38.

Andres, U.; "Parameters of Disintegration of Rock by Electrical Pulses"; 1989, Powder Technology, vol. 58, pp. 265-269.

Hasebe, Tadashi, et al.; "Focusing of Shock Wave by Underwater Discharge on Nonlinear Reflection and Focusing Effect"; English Abstract, J. Soc. Mat. Sci., Japan, vol. 45, No. 10, Oct. 1996.

Hawrylewicz, B.M., et al.; "Experiment with Electric Discharge in Rock Splitting"; Sym. on Rock Mechanics, 1986, Chapter 62, pp. 429-435.

Mao, Ronghai, et al.; "Experiments on Pulse Power Fracturing"; SPE 153805, Mar. 2012, pp. 1-16.

Maurer, William C.; "Spark Drilling"; 1969, Soc. Mining Eng. Proc. of the 11$^{th}$ Sym. on Rock Mechanics, Chapter 33, pp. 687-703.

McClung, I. Buford; "The Feasibility of Developing a Borehole Sparker for Geothermal Wells"; Jan. 1977, EG&G Energy Measurements, Inc., 1997, LOA 217, Title Page, Disclaimer, Acknowledgements, Table of Contents p. v, pp. 1-17.

Pierce, K.G., et al.; "Advanced Drilling Systems Study"; 1995, Sandia National Laboratories Report, SAND95-0331, Distribution Category UC-258, Title Page, Acknowledgements, Table of Contents, pp. I-1 through III-44 (Part 1).

(56) References Cited

OTHER PUBLICATIONS

Pierce, K.G., et al.; "Advanced Drilling Systems Study"; 1995, Sandia National Laboratories Report, SAND95-0331, Distribution Category UC-258, pp. III-45 through V-39 (Part 2).
Pierce, K.G., et al.; "Advanced Drilling Systems Study"; 1995, Sandia National Laboratories Report, SAND95-0331, Distribution Category UC-258, pp. V-40 through IX-26, Distribution—5 pages (Part 3).
International Search Report, dated May 16, 2011, during the prosecution of International Application No. PCT/US2008/084662.
Written Opinion of the International Searching Authority, dated May 16, 2011, during the prosecution of International Application No. PCT/US2008/084662.

* cited by examiner

METHOD AND APPARATUS FOR GENERATING HIGH-PRESSURE PULSES IN A SUBTERRANEAN DIELECTRIC MEDIUM

PRIORITY CLAIMS

This application claims benefit under 35 USC 119 of U.S. Provisional Patent Application Nos. 61/801,304 with a filing date of Mar. 15, 2013 and 61/868,391 with a filing date of Aug. 21, 2013, the disclosures are incorporated herein by reference in their entirety.

FIELD

The present invention relates to a method and apparatus for using an electric pulse to generate a high-pressure pulse, typically of relatively long duration, in subterranean water or other dielectric media.

BACKGROUND

Fracturing of subterranean geological structures can be useful for assisting in the development of hydrocarbon resources from subterranean reservoirs. More particularly, in certain types of formations, fracturing of a region surrounding a well or borehole can allow for improved flow of oil and gas. A conventional method for causing such fracturing in the geologic structure involves generating hydraulic pressure, which may be a static or quasi-static pressure generated in a fluid in the borehole. Another conventional method includes generation of a shock in conjunction with a hydraulic wave by creating an electrical discharge across a spark gap. U.S. Pat. No. 8,220,537, titled "Pulse fracturing device and method," describes a fracture method that includes generating an acoustic wave in a fluid medium present in the borehole.

While conventional methods have been used successfully to form fractures, there is a continued need for an improved method and apparatus for generating high-pressure pulses in a subterranean medium and causing fracturing to occur.

BRIEF SUMMARY

The present invention provides an apparatus and method for generating high-pressure pulses in a subterranean dielectric medium, including electrical pulses of relatively long duration, e.g., greater than 100 μs and, in some cases, 4 ms or longer.

The method includes providing an electrode assembly in the medium. The electrode assembly has first and second electrodes that define a gap therebetween. A shaped electric current pulse having a duration greater than 100 μs is delivered to the electrode assembly so that an electric arc is formed between the first and second electrodes, and a pressure pulse is thereby produced in the medium. For example, a substantially constant current can be maintained during the duration of the current pulse duration and the duration of the electric current pulse can be between 200 μs and 4 ms. The electric current pulse can have a voltage between 10 kV and 30 kV and a current of at least 5 kA. Each electric current pulse can delivering at least 50 kJ of energy to the electrode assembly, and the pressure produced in the medium can be at least 1 kbar for a duration of at least 10 milliseconds. The delivery of the electrical current pulse can be repeated at a frequency of at least 1 Hz.

The dielectric medium can include fluids that are found in a wellbore used for recovery of hydrocarbons from a subterranean reservoir, such as one or more of water, saline water, oil, and drilling mud.

In some cases, the pressure of the medium is increased prior to delivery of the electric current pulse. For example, a fluid can be delivered to the medium to increase the pressure of the medium to at least 5 bars prior to the delivery of the electric current pulse. Also, the dielectric medium can be a fluid that is at least partially saturated with a gas, such as ammonia, sulfur dioxide, or carbon dioxide, so that the electric arc releases some of the gas from the dielectric medium during the production of the pressure pulse, thereby increasing the pressure and/or increasing the duration of the pressure pulse. The gas can occur naturally in the dielectric fluid or can be injected into the medium prior to the delivery of the electric pulse.

According to another embodiment, the disclosure provides an apparatus for generating high-pressure pulses in a subterranean dielectric medium. The apparatus includes an electrode assembly that is configured to be disposed in the medium. The electrode assembly has first and second electrodes that define a gap therebetween. A pulser is configured to deliver a shaped electric current pulse to the electrode assembly, wherein the electric current pulse has a duration greater than 100 μs, to form an electric arc between the first and second electrodes and thereby produce a pressure pulse in the medium. For example, the pulser can be configured to deliver the electric current pulse at a voltage between 10 kV and 30 kV and at a current of at least 5 kA. The pulser can be configured to maintain a substantially constant current during the duration of the current pulse duration, and the duration of the electric current pulse can be between 200 μs and 4 ms. The pulser can be configured to deliver at least 50 kJ of energy to the electrode assembly during the electric current pulse duration.

In some cases, the first and second electrodes of the electrode assembly are disposed in an axial configuration. Each electrode can have a diameter between 0.25 cm and 4 cm, and the electrodes can define an axial gap between 0.5 cm and 4 cm therebetween. In other cases, the electrode assembly the first and second electrodes are arranged in a radial configuration, with the first electrode disposed radially within a ring configuration defined by the second electrode. Each electrode can have a thickness between 0.2 cm and 2.5 cm, and the radial gap between the electrodes can be between 0.5 cm and 4 cm.

The pulser can include an inductive pulse-forming network and an opening switch configured to deliver the electrical current pulse to the electrode. The opening switch can be a solid-state electrical switch and/or a gas-based electrical switch. The pulser can be configured to deliver a plurality of electrical current pulse to the electrode assembly at a frequency of at least 1 Hz.

The apparatus can also include a pressure device configured to deliver a flow of fluid to the medium to increase the pressure of the medium to at least 5 bars.

In a typical operation, one or more electrical discharges or arcs are formed in the water or other dielectric media. Although the present invention is not limited to any particular theory of operation, it is believed that the arc vaporizes and ionizes the dielectric medium in the arc. It is also believed that the temperature of the medium's vapor increases, the size of the plasma channel increases, and a point is reached at which the impedance of the arc decreases rapidly with increasing current through the arc as the vapor ionizes. In some cases, the energy delivered to the dielectric medium may not be sufficiently increased by simply increasing the current because the electrical coupling efficiency (i.e., the ability to create a pressure pulse by the discharge of the electrical pulse in the medium) may decreases as the resistivity falls. However, it is believed that a good coupling efficiency can be maintained by limiting the peak value of the arc current and providing an initial, static pressure to the water so that the impedance of the water arc is maintained at an appropriate level. To deliver additional energy to the dielectric medium, the pulse duration of the arc can be increased while maintaining nearly constant current and, typically, generating a pressure in the medium that increases with time. Such arcs can be maintained stably for durations of at least several milliseconds. During this time, the impedance of the arc may either remain constant or slowly increase. By lengthening the duration of the pulse, it is believed that the total energy delivered to the medium can be increased, e.g., to achieve a desired degree of subterranean fracturing in a hydrocarbon production operation.

DETAILED DESCRIPTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
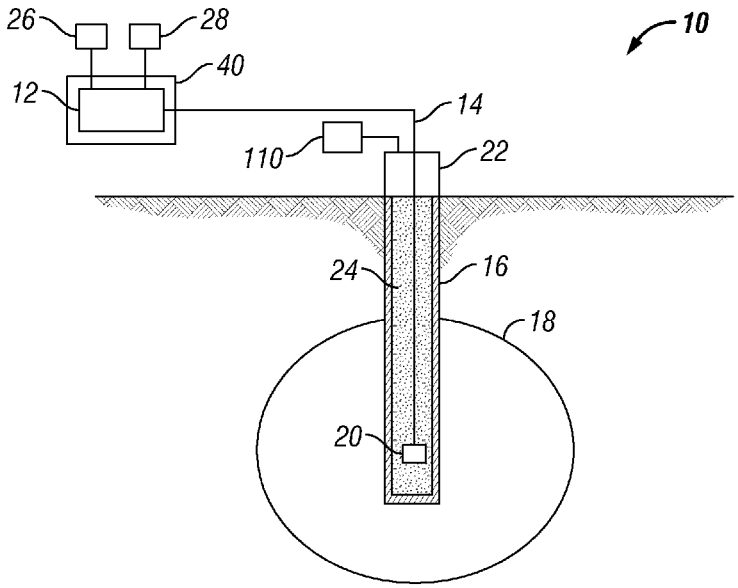
FIG. 1 is a schematic view illustrating an apparatus for generating high-pressure pulses in a subterranean dielectric medium according to one embodiment of the present invention.

Referring to FIG. 1, there is shown an apparatus 10 for generating high-pressure pulses in a subterranean dielectric medium according to one embodiment of the present disclosure. The apparatus 10 includes a pulser 12 that is configured to deliver a high voltage current through an electrical cable 14, which can be disposed within a wellbore 16 that extends to a subterraneous hydrocarbon reservoir 18. The cable 14 electrically connects the pulser 12 to an electrode assembly 20, so that the pulser 12 can power the electrode assembly 20 and generate a pulse in the wellbore 16.

The wellbore 16 can have portions that extend vertically, horizontally, and/or at various angles. Conventional well equipment 22 located at the top of the wellbore 16 can control the flow of fluids in and out of the wellbore 16 and can be configured to control the pressure within the wellbore 16. The wellbore 16 can be at least partially filled with the medium, which is typically a fluid 24 such as water, and the equipment 22 can pressurize the fluid as appropriate.

Figure 2:
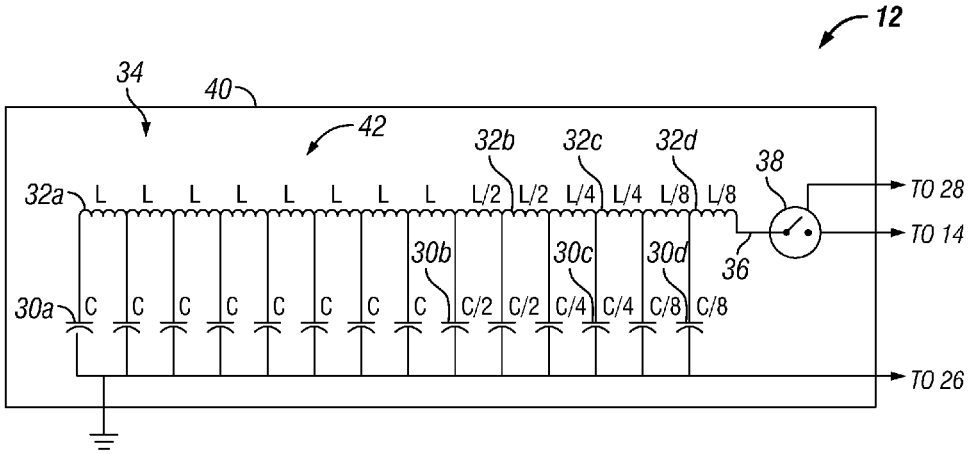
FIG. 2 is a schematic view illustrating the pulser of the apparatus of FIG. 1.
Figure 3:
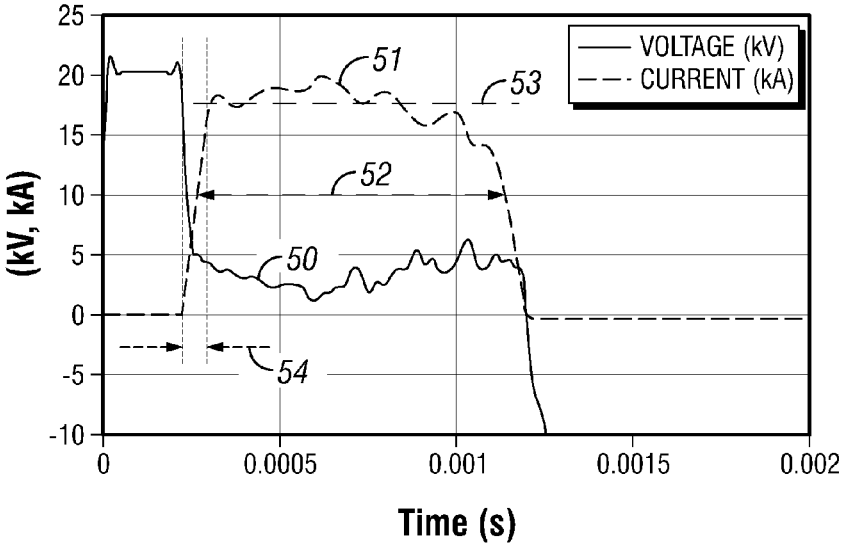
FIG. 3 is a graphic illustration of the voltage and current applied by the pulser to the electrode assembly and flowing through an arc formed in water as a function of time during operation of an apparatus according to the present disclosure.

The pulser 12 is connected to a power source 26, e.g., a device configured to provide electrical power, typically DC. A controller 28 is also connected to the pulser 12 and configured to control the operation of the pulser 12. The pulser 12 can include an electrical circuit that is configured to generate a shaped or tailored electric pulse, such as a pulse having a square (or nearly square) voltage profile, as shown in FIG. 3. For example, as shown in FIG. 2, the electrical circuit of the pulser 12 can include a plurality of capacitors 30*a*, 30*b*, 30*c*, 30*d* (collectively referred to by reference numeral 30) and inductors 32*a*, 32*b*, 32*c*, 32*d* (collectively referred to by reference numeral 32) that are arranged in parallel and series, respectively, to form a pulse-forming network ("PFN") 34. The values of the capacitors 30 and inductors 32 can vary throughout the network 34 to achieve the desired pulse characteristics. For example, each of the capacitors 30*a* in a first group (or stage) of the capacitors can have a value C, such as 100 μF, and each of the inductors 32*a* in a first group (or stage) of the inductors can have a value L, such as 80 μH. Each of the capacitors 30*b* in a second group of the capacitors can have a lesser value, such as ½ C, and each of the inductors 32*b* in a second group of the inductors can have a lesser value, such as ½ L. Each of the capacitors 30*c* in a third group of the capacitors can have a still lesser value, such as ¼ C, and each of the inductors 32*c* in a third group of the inductors can have a still less value, such as ¼ L. Each of the capacitors 30*d* in a fourth group of the capacitors can have a still lesser value, such as ⅛ C, and each inductor 32*d* in a fourth group of the inductors can have a still less value, such as ⅛ L.

A ground of the PFN 34 is connected to the power source 26, and the PFN 34 is configured to be energized by the power source 26. An output 36 of the PFN 34 is connected to the cable 14 through a switch 38, such as a solid-state IGBT switch or another thyristor, which is connected to the controller 28 and configured to be controlled by the controller 28, so that the controller 28 can selectively operate the pulser 12 and connect the PFN 34 to the cable 14 to deliver a pulse to the electrode assembly 20. For example, the switch 38 can be a device that is capable of handling a peak voltage of at least 20 kV, a maximum current of at least 20 kA, and a maximum charge of at least 100 C. Such IGBT switches can be assembled by placing commercially available IGBTs in series and parallel in order to obtain the necessary voltage and current handling capabilities. In some cases, other types of switches may be usable, such as gas switches of a sliding spark design.

It is also appreciated that the pulser 12 can use other energy storage devices, other than the illustrated PFN 34. For example, while the illustrated embodiment uses capacitive energy storage based on a Type B PFN configuration, it is also possible to use a PFN based on inductive energy storage and a solid-state opening switch. An inductive PFN could allow a smaller design and could also allow a lower voltage during the charging phase (e.g., a typical charging voltage of about 1 kV in the inductive PFN instead of a typical charging voltage of about 20 kV in a capacitive PFN) and only operate at high voltage for a short period (such as a few microseconds) during the opening of the switch 38.

The controller 28 can repeatedly operate the pulser 12 to deliver a series of discrete pulses. One typical repetition rate is about one pulse per second, or 1 Hz. In other cases, the pulser 12 can be operated more quickly, e.g., with a repetition rate as fast as 5 Hz or even faster, depending on the need of the particular application. If a much lower repetition rate is acceptable (such as less than 0.1 Hz), then other electrical gas switches that are unable to provide fast repetition may be usable.

The pulser 12 can be actively or passively cooled. For example, as shown in FIG. 2, the pulser 12 can be disposed in an enclosure 40 that is filled with a thermally conductive fluid 42 such as oil that cools the pulser 12. Additional equipment, such as a radiator and/or fans, can be provided for actively cooling the oil 42. In other cases, the pulser 12 can be air-cooled.

In one embodiment, the pulser 12 is configured to operate with an output voltage of between 10 kV and 30 kV, such as about 20 kV. The pulser 12 can generate a peak current between 10 kA and 20 kA, such as between 12 kA and 15 kA, depending on the impedance of the impedance of the cable 14 and the impedance of the arc generated in the dielectric fluid. The impedance of the PFN 34 can be matched to the expected impedance load at the electrode assembly 20, e.g., between 0Ω and 1Ω, such as between 0.5Ω and 0.9Ω. In another case, the peak current was kept below about 20 kA and the medium was pressurized, resulting in an impedance between 0.1Ω and 0.4Ω.

FIG. 3 shows the electrical waveform of a typical voltage pulse 50 and a typical current pulse 51 during operation of the apparatus 10. The current pulse 51 has a pulse width 52 that is determined, at least partially, by the number of elements in the PFN 34 shown in FIG. 2. The magnitude of the current 53 is determined, at least partially, by the values of the capacitors 30 and inductors 32 of the PFN 34. The rise time 54 of the current waveform 51 is determined, at least partially, by the first-group elements 30*a*, 32*a* of the PFN 34.

Figure 4:
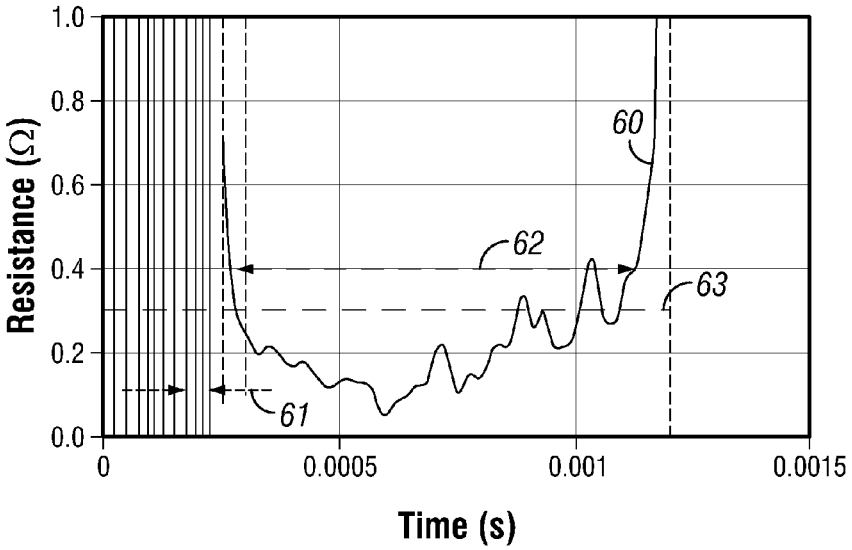
FIG. 4 is a graphic illustration of the impedance as a function of time of an electric arc formed in water during operation of an apparatus according to the present disclosure.

FIG. 4 shows the impedance 60 of one typical water arc as a function of time during operation of the apparatus 10. The rapid fall time of the impedance 62 is driven by the rapid rise of the current 54. The pulse width of the current 52 is reflected in the impedance as the pulse width of the impedance 62. The average magnitude of the impedance 63 is determined, at least partially, by the electrode geometry, the peak current 53, and the static pressure applied to the load. The average impedance 63 is nearly constant (even slightly increasing) with time.

The current can be maintained at a substantially constant level for the duration of the pulse. The pulse can be maintained to achieve a pulse length, or duration, of greater than 100 μs. For example, the embodiment between 200 μs and 4 ms. Further, in other embodiments, the pulser 12 can provide a pulse duration of more than 4 ms, e.g., by adding additional capacitors 30*a* in the first group of capacitors.

Although other configurations of the PFN 34 are possible, the illustrated configuration is known as a pulsed current generator in a Type B PFN configuration, which can provide a substantially constant current pulse to electrode assembly 20 and the art formed therein through the dielectric medium. The PFN-based pulser 12 allows control of the current that drives the discharge.

Although the present invention is not limited to any particular theory of operation, it is believed that the highest value capacitors 30*a* and inductors 32*a* can provide or define the basic pulse shape and the pulse duration, and the other capacitors 30*b*, 30*c*, 30*d* (and, optionally, additional capacitors) and inductors 32*b*, 32*c*, 32*d* (and, optionally, additional inductors) reduce the rise time of each pulse provided by the PFN 34. More particularly, the rise time can be determined by the rise time of the first group of capacitors 30*a* and inductors 32*a*. The PFN 34 can be designed to have a rise time of less than 100 μs, such as between 20 μs and 75 μs, typically between 25 μs and 50 μs, depending on the inductance of the cable 14, the smallest capacitance in the PFN 34, and the load at the electrode assembly 20. In general, shorter rise times can be effective, while longer times tend to have higher levels of break down jitter and longer delays between the application of voltage to the electrodes and the development of an arc.

An appropriate selection of the values of the capacitors 30 and inductors 32 in the PFN 34 can limit the peak current that the PFN 34 delivers. This is the effect of the impedance of the PFN 34, where the PFN 34 impedance ($Z_{PFN}$) is given as follows:

$$Z_{PFN} = \sqrt{\frac{L}{C}},$$

where L can C are the inductance and capacitance of the PFN 34.

In a typical case, values of $Z_{PFN}$ are roughly in the range of 0.5Ω to 1Ω. Typically, the rise time of the current pulse from the PFN 34 is proportional to the square root of the LC of the individual elements of the PFN 34. For a load impedance greater than the impedance of the PFN 34, the rise time ($t_{rise}$) can be about ¼ the LC period, given as follows:

$$t_{rise} \cong \frac{\pi}{2}\sqrt{LC}$$

The peak current ($I_{peak}$) of an element of the PFN 34 can be proportional to the voltage on the capacitor ($V_0$), the square root of the capacitance in inversely proportional to the square root of the inductance of the element of the PFN 34 (if the impedance of the PFN 34 is larger than the load impedance), as follows:

$$I_{peak} = \frac{V_0}{Z_{PFN}} = V_0\sqrt{\frac{C}{L}}.$$

In the illustrated embodiment, the PFN 34 is modified to have smaller capacitors 30*b*, 30*c*, 30*d* and inductors 32*b*, 32*c*, 32*d* precede the main set of capacitors 30*a* and inductors 32*a* to provide improved current rise time. Thus, the smaller-value capacitors 30*b*, 30*c*, 30*d* and smaller-value inductors 32*b*, 32*c*, 32*d* can be selected with values that are sized to maintain the same value of current but will provide a smaller time to peak current as the first few elements in the PFN 34. By using this approach, the modified PFN can be made to have a rise time less than 50 μs and yet having a total duration ranging from about 200 μs to several ms. The total energy (E) stored in the PFN 34 can be the sum of the energies stored in all of the capacitors of the PFN 34 and is expressed as follows:

$$E = 0.5\ V^2 \sum_{i=1}^{n} C_i.$$

The energy coupled to the dielectric medium discharge can reach or even exceed 500 kJ for reasonable PFN 34 parameters and charge voltages. The number of capacitors 30 inductors 32 in the PFN 34 can determine the pulse length of the current pulse delivered to the arc. The pulse width of the PFN 34 can be determined by the sum of the capacitances and inductances of the entire PFN 34. For example, in the illustrated embodiment, the duration of each pulse, or pulse width ($t_{pw}$), of the PFN 34 is given as follows:

$$t_{pw} = 2\left(\sum_{i=1}^{n} L_i \sum_{i=1}^{n} C_i\right)^{0.5}.$$

In one example, the pulse width is between about 1 ms and 4 ms, the total capacitance of the PFN 34 is between about 1 mF and 4 mF, the peak current is about 15-18 kA, and the total inductance of the PFN 34 is between about 0.4 mH and 1.6 mH. In other cases, where less energy is required and a shorter pulse is desirable, the number of stages of first-group capacitors 30*a* and first-group inductors 32*a* can be reduced to decrease the pulse length and stored energy. One such embodiment would use only 5 capacitors 30*a* and 5 inductors 32*a* in the first group, together with the faster stages (30*b*, 30*c*, 30*d* and 32*b*, 32*c*, 32*d*) to generate a 1-ms pulse.

The total energy of the pulse can also be varied according to the fracturing needs of a particular reservoir. In some cases, the total energy of each pulse can be between 50 kJ and 500 kJ, e.g., 450 kJ. The total energy per pulse can be reduced, if needed, by reducing the number of the capacitors 30*a* in the first group of the PFN 34, or the energy per pulse can be increased by adding to the number of the capacitors 30*a* in the first group of the PFN 34.

Figure 5A:
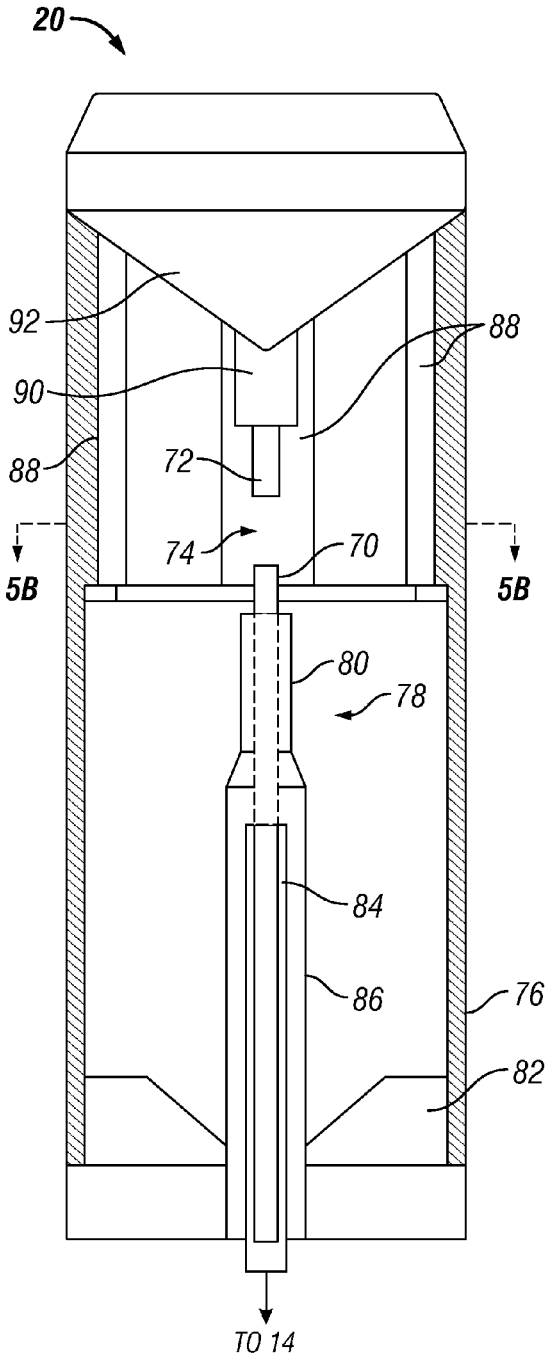
FIG. 5A is a schematic view illustrating the electrode assembly of the apparatus of FIG. 1.
Figure 5B:
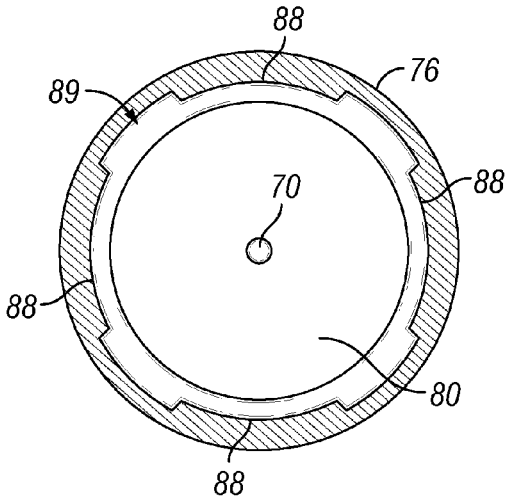
FIG. 5B is a sectional view of the electrode assembly of FIG. 5A, as seen along line 5B-5B.

It is appreciated that the pulser 12 can be optimized to provide a pulse length (by adjusting the number of groups of capacitors 30 and inductors 32 in the PFN 34), rise time (by adjusting the size of the smaller-value capacitors 30*b*, 30*c*, 30*d* and inductors 32*b*, 32*c*, 32*d* in the PFN 34), maximum voltage, and repetition rate depending on the specific application and manner of use. Generally, it is believed that a current greater than about 20 kA for pulses in water may result in arc impedances that are too low for efficient energy coupling. On the other hand, arc currents that are too low may be subject to uncontrolled arc quenching for longer pulses. The electrode assembly 20 is connected to the cable 14 and configured to create one or more electric arcs when the electric pulse is delivered via the cable 14. For example, FIGS. 5A and 5B show an electrode assembly 20 configured to form an electric arc between a first (or high voltage) electrode 70 and a second (or ground) electrode 72 that are positioned with an axial gap 74 therebetween. The electrodes 70, 72 are disposed in assembly housing 76 so that the electric arc can be formed across the gap 74 therebetween in the axial direction of the electrode assembly 20. The first electrode 70 is mounted in a conducting electrode holder 78, e.g., by a press fit. The first electrode 70 and the holder 78 are disposed in an insulator 80, such as high-density polyethylene (HDPE), which is retained in the assembly housing 76 with a compression ring 82. The cable 14 is connected to the first electrode 70 via the electrode holder 78 with an electrical connector 84. The electrical connector 84 is surrounded by an insulative material 86, such as a highly compressed, oil-saturated foam 29. The assembly housing 76 has a plurality of circumferentially spaced vanes 88 that electrically and mechanically connect the lower portion of the assembly housing 76 to the second electrode 72 by way of a conductive electrode mounting 90 and a conductive shock reflecting base 92. As shown in FIG. 5B, the vanes 88 define gaps 89 therebetween so that the pressure pulse can be transmitted outside the housing 76 to the dielectric medium 24 in the wellbore 16. In other embodiments, the vanes 88 can be smaller or larger than as shown in FIG. 5B.

Figure 6A:
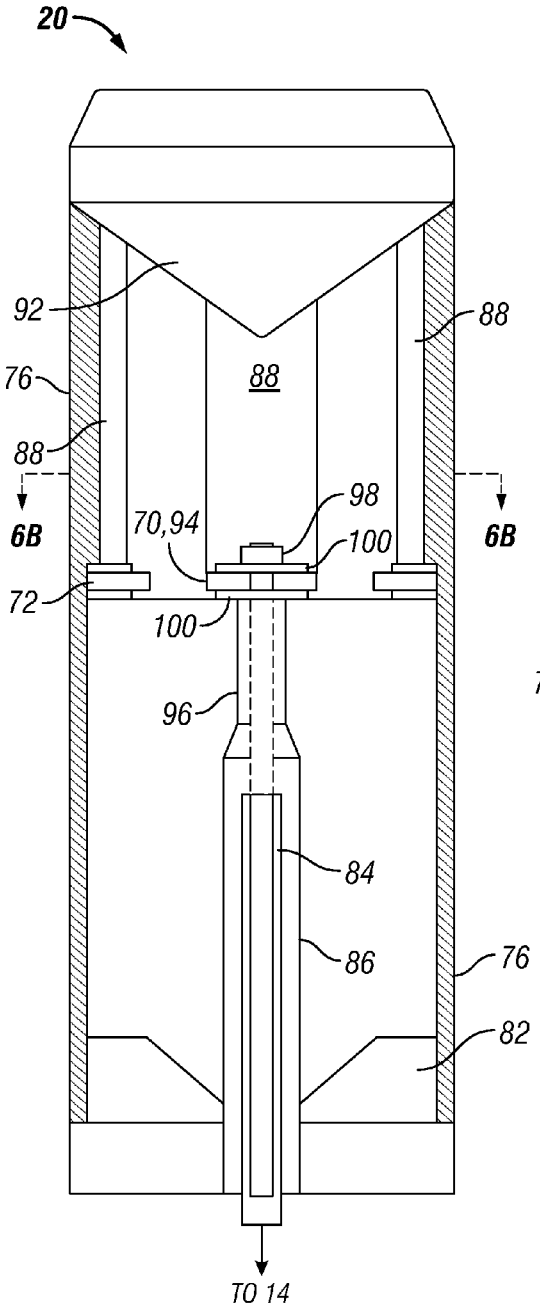
FIG. 6A is a schematic view illustrating an electrode assembly according to another embodiment of the present disclosure.
Figure 6B:
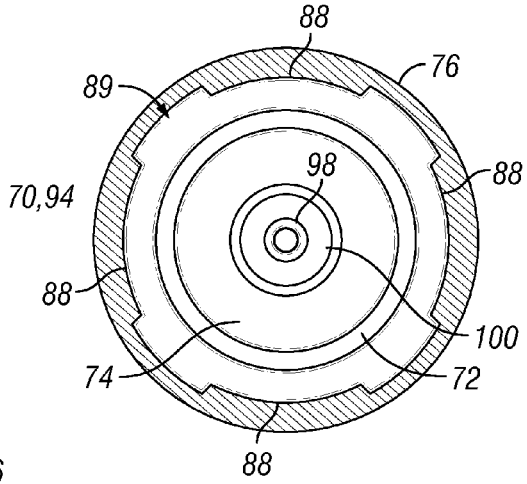
FIG. 6B is a sectional view of the electrode assembly of FIG. 6A, as seen along line 6B-6B.

FIGS. 6A and 6B illustrate another embodiment of the electrode assembly 20 in which the electrodes 70, 72 are configured in a radial arrangement so that the arc is formed radially. In this case, the first electrode 70 includes a cylindrical element 94 mounted on a conducting base 96 via a bolt 98, with retaining members 100 disposed axially opposite the cylindrical element 94. The second electrode 72 extends circumferentially on the inner surface of the housing 76, with the gap 74 defined radially between the first and second electrodes 70, 72 so that the arc can be formed in the radial direction.

The dimensions of the insulator 80 can be designed according to the structural and electrical requirements of the electrode assembly 20. In the illustrated embodiment, the diameter of the insulator 80 is about 10 cm, and the length of the insulator 80 is typically equal to or greater than its diameter. A variety of insulative materials can be used for the insulator 80, such as Polytetrafluoroethylene (PTFE), available under the trade name, Teflon®, which is a mark of E. I. du Pont de Nemours and Company, high-density polyethylene (HDPE), ultra-high-molecular-weight polyethylene (UHMW PE), and nylon.

The overall dimensions and specifications of the electrode assembly 20 can be designed according to its intended use and the parameters of its individual components. In some cases, the first electrode 70 can have a diameter of between 0.5 cm and 5 cm, such as about 1 cm. The first electrode 70 typically has a relatively small portion of exposed surface area exposed to the dielectric fluid to minimize current leakage between the time when a voltage is applied to the electrode assembly 20 during the electric pulse until the electric discharge in the dielectric fluid begins.

In the illustrated embodiment, the positive voltage is applied to the first electrode 70 and the second electrode 72 is grounded, as it is believed that the negative electrode may tend to erode more quickly than the positive electrode. The second (ground) electrode 72 typically has a diameter that can be the same or larger than the first electrode 70. The second electrode 72 can include additional mass to help extend the useful lifetime of the electrode 72 and the electrode assembly 20.

The electrodes 70, 72 can be configured to define with a gap 74 therebetween within the range of 0 to 5 cm, typically between 1 cm and 3 cm, such as about 2 cm. During use of the electrode assembly 20, the electrodes 70, 72 can erode, and the gap 74 can increase. As the gap 74 increases, the impedance of the dielectric fluid between the electrodes 70, 72 will also increase. Upon a certain amount of erosion from the electrodes 70, 72, e.g., when the gap 74 becomes 2.5 cm or more, the electrode assembly 20 can be refurbished or replaced.

The electrodes 70, 72 are typically formed of a material that is sufficiently mechanically robust to withstand multiple pulses from the pulser 12. Such materials include steels (e.g., stainless steel or hard carbon steels), refractory metals (such as tungsten, tantalum, or tungsten alloys), nickel alloys (such as an alloy available under the tradename Hastelloy®, a trademark of Haynes International, Inc.) and carbon (such as graphite or carbon-carbon composites). Refractory alloys of tungsten have been observed to erode at a relatively low rate. In particular, the electrodes 70, 72 can be made of a material formed of a mixture of tungsten and up to 10% copper. For example, one such alloy is commercially available under the trade name Elkonite® 50WC, a trademark of CMW International Inc. The electrode assembly 20 is also typically designed to be capable of withstanding static pressure up to 100 bars and a peak dynamic pressure of at least 1 kbar.

As shown in FIG. 1, the pulser 12 is connected to the electrode assembly 20 via the cable 14. The cable 14 is typically a low-impedance electrical conductor, which includes one or more electrical conductors in an insulative sheath. The impedance of the electrical connections and conductors can be less than the impedance of the electrode assembly 20 (including the impedance across the gap 74 between the electrodes 70, 72) and the effective combined impedance of the capacitors 30 and inductors 32 so that the stored electrical energy is effectively coupled to the arc formed across the gap 74.

In use, the pulser 12 can deliver an electric current pulse to the electrode assembly 20 so that an electric arc is formed across the gap 74 between the electrodes 70, 72 and the electrode assembly 20 thereby produces a pressure pulse in the fluid 22. Electrical pulses of long duration and high energy can be used to produce pressure pulses that are also long in duration and of high pressure.

The apparatus 10 can be used to generate such pulses in various types of dielectric media, such as media that include water; saline water; oil; freon and silicon oils; mixtures of oil and water; mixtures of oil, water, & drilling mud; liquid or solid plastics; and mixtures of any of the foregoing, with or without dissolved gases. For example, in the case of a wellbore 16 used for producing hydrocarbons from a subterranean reservoir, the wellbore 16 can be filled with a naturally occurring mixture that is predominantly water, or fluids can be injected into the wellbore 16 to increase the effectiveness of the pulsing operation.

Dissolved gas in the medium can result in increased pressure generation. It is believed that some of the dissolved gas can be released from a liquid medium when the liquid medium is shocked to either higher or lower pressures. Dissolved gas may be naturally occurring in the medium and/or injected into the medium for that purpose. For example, dissolved ammonia, sulfur dioxide, or carbon dioxide can be injected in the medium at any amounts, potentially up to the saturation limit of the medium. In water, a 10% molar fraction of dissolved gas can be achieved readily at pressures above 1 bar at room temperature. The application of 100's of kJ of energy to the water together with a shock wave that generates strong cavitation can release much of the dissolved gas(es) in the dielectric medium within a period of 100 μs-500 μs. This can provide a relatively continuous increase in pressure in the time following the shock that can result in a pressure pulse that lasts more than 10 ms. Some solid hydrates exhibit a similar behavior and can be used in a similar fashion.

In one embodiment, where the wellbore 16 contains a dielectric medium that is mostly water, a gas is provided in the medium in a concentration of greater than 1% molar fraction of ammonia, sulfur dioxide, or carbon dioxide. The heating of the medium by the electrical discharge can release several moles of gas from the volume of the electrode assembly 20, e.g., more than 44 liters of gas at standard temperature and pressure. In the same dielectric medium, when pressurized to 100 bars and a temperature of 100 C, a gas volume of about 1 liter can be released, such volume being comparable to the volume of the chamber defined within the electrode assembly 20. The generation of one or more liters of gas can create a long duration pressure pulse, e.g., extending for 10 ms or longer and far beyond the duration of the electric pulse.

A pressure device 110 can be connected to the well equipment 22 and configured to pressurize the dielectric medium to an increased pressure before the pulsing operation. For example, the pressure device 110 can be a fluid delivery device that is configured to inject a hydraulic, pneumatic, or other fluid to vary the pressure in the wellbore 16 and thereby optimize the coupling of the electrical energy to the arc and, hence, the magnitude and/or duration of the electro-hydraulic dynamic pressure that is generated by the electrical discharge. For example, prior to and during the electrical discharge by the apparatus 10, a static pressure can be applied to the dielectric medium, or a slow-pulse quasi-static pressure can be applied to the dielectric medium. In some cases, the pressure device 110 can increase the pressure of the dielectric medium in the wellbore 16 to an absolute pressure of between 5 and 100 bars during the pulsing operation. In other cases, the pressure device 110 can be configured to provide even higher pressures, such as to 200 bars, e.g., in deeper reservoirs where the naturally occurring pressure is high. It is believed that, the apparatus 10 can develop arcs in pressurized water that have a higher impedance than typical arcs in water at lower pressures. It is also believed that the initial pressure in the medium can retard the early-time expansion of the arc plasma. Later, the increase in dynamic pressure generated by the arc itself can feed back on the arc dynamics and continue to confine the now-hotter arc channel.

Although the present invention is not limited to any particular theory of operation, it is believed that short-pulse electrical discharges are limited in the amount of electrical power that can be efficiently coupled to a resistive water arc. As the arc current is raised to increase electrical power (and the energy delivery per pulse), the resulting electrical heating of the water arc plasma decreases the impedance of the arc both through the Spitzer resistivity (ρS) which scales inversely with plasma temperature (T) to the 3/2 power, and also by increasing the diameter of the discharge driven by pressure balance. The Spitzer resistivity is defined as follows:

$$\rho_S = \frac{\bar{Z}\ln\Lambda}{T^{3/2}}.$$

The Spitzer resistivity effectively becomes proportional to T3/2 because the plasma parameter, ln Λ, is a very weakly varying function of density and temperature and in this case ranges from 1 to 4, and Z is the average ionization level of the plasma and is typically about 1 for water arcs. The total impedance of the arc channel is inversely proportional to the mean cross-sectional area of the arc and proportional to the length of the arc. Heating the water-arc plasma increases the plasma pressure and expands the arc against the water and decreases the overall arc impedance. Dynamic pressure balance sets the time-dependence of the arc diameter and, hence, the arc area.

In operation, it is believed that a short time delay can occur after a voltage pulse is applied to the conducting electrodes 70, 72 and before the arc forms in the dielectric medium across the gap 74 between the electrodes 70, 72. This delay can be in the range of 50 μs to several hundred microseconds. Once a breakdown occurs, the voltage across the electrode gap 74 (i.e., the arc) drops and the current rapidly increases to a maximum voltage, as determined by the PFN 34 and the impedance of the arc. This is due to the rapid change in the impedance of the arc in time. The impedance can fall to a nearly steady-state value that is determined by the length of the discharge, the peak current of the discharge, the electrode geometry (field enhancement), the initial static pressure, and the final dynamic pressure on the arc. Because the duration of the current pulse is much longer than the acoustic time of the system, the arc can see an increase in the dynamic pressure during the pulse. Thus, later in time, the pressure in the system is higher and the arc impedance is able to remain substantially constant over a long period of time.

In some cases, an active trigger system may be desirable. For example, a liquid with a high conductivity may cause significant energy loss from the PFN 34 before the arc initiates. In that case, the apparatus 10 can include an active trigger feature, which involves the application of voltages of order 50 kV or greater to the electrodes 70, 72, to reduce the resistive losses in the conducting dielectric medium.

The initial formation and heating of the arc can generate a high-pressure shock, and the pressure shock can be characterized by a relatively short rise time, such as a rise time of less than 50 μs. The duration of the electrical drive pulse is typically longer than the acoustic transit time of the system. The multiple shocks that are generated in the arc can equilibrate and create a long-duration, dynamic pressure pulse on the system. The dynamic pressure in the system can tend to increase as long as electrical energy is delivered to the load. When the input electrical energy from the pulser 12 ceases, the pressure begins a relatively slow decay, with the decay time typically depending on the specific mechanical details of the system. In testing, energies above 100 kJ delivered to a load region resulted in generation of pressures greater than 1 kbar (15 kpsi) in an enclosed or substantially enclosed chamber with a volume of about 1 liter. It is believed that lower peak pressures and shorter pressure durations would be generated in a larger-volume configuration, such as would typically be present in the wellbore 16. Higher peak pressures are possible if the total volume is smaller and/or if more energy is delivered to the load.

It is also believed that the electrode dimensions (length and diameter for axial electrodes 70, 72 as shown in FIG. 5, and axial height and radial length for radial electrodes 70, 72, as shown in FIG. 6) can have several significant effects on the performance of the apparatus 10. First, the diameter of axial electrodes 70, 72 and the electrode spacing can determine, at least partially, the average electric field strength seen at the surface of the electrodes 70, 72. It is believed that a higher electric field at the surface of the electrode 70 typically correlates with a more rapid formation of the electrical arc. Thus, if it is desirable to have a large geometrical field enhancement for a particular application, smaller diameter electrodes 70, 72 may be preferred. Second, larger electrode diameter for an axial electrode 70, 72 typically correlates with more electrode mass being available to erode during many discharges (e.g., hundreds of discharges during hundreds of operations of the electrode assembly 20). To reduce erosion, it may be desirable to have the largest-diameter, most massive electrode 70, 72 reasonably possible while staying within other design constraints. Third, leakage current in conductive water (e.g., salinity greater than 1000-ppm total dissolved solids) can be reduced if the total area of the high-voltage electrode 70 is reduced. Thus, in some cases, it may be desirable to minimize the surface area of the high-voltage electrode 70 to reduce leakage current. It is appreciated that the three above-noted drivers for the design of the electrode dimensions are partly conflicting. For example, if a small electrode diameter is chosen to reduce leakage prior to arcing, the electric field enhancement may be too low, there may be a very slow development of the precursor streamers that eventually form arcs, and the arcs that do form may have very little preferential direction. In extreme cases, arcs may propagate from the high-voltage electrode 70 to any adjacent ground location. Also, if the diameter of the electrode 70 is too small, then the useful lifetime of the electrode 70 may be short due to excessive erosion. On the other hand, if the diameter and length of the first electrode 70 are too large, then the leakage current may be very large, and too much energy may be lost before the arc forms.

A rapid current rise time can help minimize the unwanted parasitic arcs and reduce the delay between the application of the voltage to the electrodes 70, 72 and the formation of an arc for larger diameter electrodes 70, 72. One way to minimize the leakage current from the first electrode 70 is to coat the electrode 70 with an appropriate insulating material, such as epoxy, e.g., thermosetting resin available under the trade name of Scotchcast®, a trademark 3M Company. That is, the curved, radially outward surface of the electrode 70 can be coated, and the coating can erode away as the electrode 70 erodes. In tests, a coated electrode 70 having a diameter of about 2.5 cm was demonstrated to work well when pulsed with an electric pulse having a rise time of about 50 μs or less.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed:

1. A method for generating high-pressure pulses in a subterranean dielectric medium, the method comprising:

providing an electrode assembly in the dielectric medium, the electrode assembly having an assembly housing, the electrode assembly further having a first electrode positioned within and supported by the assembly housing and having a second electrode positioned within the assembly housing, wherein the first and second electrodes of the electrode assembly are arranged in a radial configuration, with the first electrode disposed radially within a ring defined by the second electrode, and a radial gap between the first and second electrodes, wherein the first electrode and the second electrode have a cylindrical shape, and wherein at least one of the first electrode and the second electrode have an axial length of at least 10 millimeters; and delivering a shaped electric current pulse from a pulser to the electrode assembly, the electric current pulse having a duration greater than 100 μs and maintaining a substantially constant current during the duration of the electric current pulse, such that an electric arc is formed between the first and second electrodes, and thereby producing a pressure pulse in the dielectric medium, wherein the pulser further comprises a pulse-forming network including a plurality of capacitors arranged in parallel and a plurality of inductors arranged in series.

2. The method of claim 1 further comprising, prior to the step of delivering the electric current pulse, delivering a fluid to the dielectric medium to increase the pressure of the medium to at least 5 bars.

3. The method of claim 1 wherein the step of delivering the electric current pulse comprises forming the electric arc through the dielectric medium comprising a fluid that is at least partially saturated with a gas comprised of at least one of the group consisting of ammonia, sulfur dioxide, and carbon dioxide, such that at least some of the gas in the fluid of the dielectric medium is released during the production of the pressure pulse.

4. The method of claim 1 wherein the step of delivering the electric current pulse comprises delivering a voltage between 10 kV and 30 kV to the electrode assembly.

5. The method of claim 1 wherein the step of delivering the electric current pulse comprises delivering a current of at least 5 kA for the electric current pulse duration.

6. The method of claim 1 wherein the duration of the electric current pulse is between 200 μs and 4 ms.

7. The method of claim 1 wherein the dielectric medium comprises at least one of the group consisting of water, saline water, oil, or drilling mud.

8. The method of claim 1 wherein the step of delivering the electric current pulse comprises delivering at least 50 kJ of energy to the electrode assembly during the electric current pulse duration.

9. The method of claim 1 wherein the step of delivering the electric current pulse and producing the pressure pulse in the medium comprises producing a pressure of at least 1 kbar for a duration of at least 10 milliseconds in the medium.

10. The method of claim 1 further comprising repeating the step of delivering the electric current pulse to the electrode assembly at a frequency of at least 1 Hz.

11. The method of claim 1 wherein each electrode having a thickness between 0.2 cm and 2.5 cm and the radial gap between the first and second electrodes being between 0.5 cm and 4 cm.

12. An apparatus for generating high-pressure pulses in a subterranean dielectric medium, the apparatus comprising:

an electrode assembly configured to be disposed in the dielectric medium, the electrode assembly having an assembly housing, the electrode assembly further having a first electrode positioned within and supported by the assembly housing and having a second electrode positioned within the assembly housing, wherein the first and second electrodes of the electrode assembly are arranged in a radial configuration, with the first electrode disposed radially within a ring defined by the second electrode, and a radial gap between the first and second electrodes, wherein the first electrode and the second electrode have a cylindrical shape, and wherein at least one of the first electrode and the second electrode have an axial length of at least 10 millimeters; and a pulser configured to deliver a shaped electric current pulse to the electrode assembly, the electric current pulse having a duration greater than 100 μs and maintaining a substantially constant current during the duration of the electric current pulse, to form an electric arc between the first and second electrodes and thereby produce a pressure pulse in the dielectric medium, wherein the pulser further comprises a pulse-forming network including a plurality of capacitors arranged in parallel and a plurality of inductors arranged in series.

13. The apparatus of claim 12 further comprising a pressure device configured to deliver a flow of fluid to the medium to increase the pressure of the dielectric medium to at least 5 bars.

14. The apparatus of claim 12 wherein the pulser is configured to deliver the electric current pulse at a voltage between 10 kV and 30 kV.

15. The apparatus of claim 12 wherein the pulser is configured to deliver the electric current pulse at a current of at least 5 kA.

16. The apparatus of claim 12 wherein the duration of the electric current pulse is between 200 μs and 4 ms.

17. The apparatus of claim 12 wherein the pulser is configured to deliver at least 50 kJ of energy to the electrode assembly during the electric current pulse duration.

18. The apparatus of claim 12 wherein each electrode having a thickness between 0.2 cm and 2.5 cm and the radial gap between the first and second electrodes being between 0.5 cm and 4 cm.

19. The apparatus of claim 12 wherein the pulser is configured to deliver a plurality of electric current pulses to the electrode assembly at a frequency of at least 1 Hz.

20. The apparatus of claim 12 wherein the pulser comprises a solid-state electrical switch configured to deliver the electric current pulse to the electrode assembly.

21. The apparatus of claim 12 wherein the pulser comprises a gas-based electrical switch to deliver the electric current pulse to the electrode assembly.

22. The apparatus of claim 12 in which the pulser comprises an inductive pulse-forming network and an opening switch configured to deliver the electric current pulse to the electrode assembly.

* * * * *